US007455750B2

(12) United States Patent
Conley et al.

(10) Patent No.: US 7,455,750 B2
(45) Date of Patent: Nov. 25, 2008

(54) META- AND PARA-ARAMID PULP AND PROCESSES OF MAKING SAME

(75) Inventors: Jill A. Conley, Chesterfield, VA (US); Lenard Oscar Lundblad, Richmond, VA (US); Edmund A. Merriman, Midlothian, VA (US)

(73) Assignee: E.I. du Pont de Nemours and Company, Wilmington, DE (US)

( * ) Notice: Subject to any disclaimer, the term of this patent is extended or adjusted under 35 U.S.C. 154(b) by 459 days.

(21) Appl. No.: 10/877,860

(22) Filed: Jun. 25, 2004

(65) Prior Publication Data

US 2005/0284596 A1 Dec. 29, 2005

(51) Int. Cl.
*D21H 13/26* (2006.01)

(52) U.S. Cl. ..... 162/157.3; 241/21; 523/149; 523/220

(58) Field of Classification Search ..... 523/149, 523/220; 162/157.3; 241/21
See application file for complete search history.

(56) References Cited

U.S. PATENT DOCUMENTS

| | | | | |
|---|---|---|---|---|
| 3,018,091 | A | 1/1962 | Duggins | |
| 3,063,966 | A | 11/1962 | Kwolek et al. | |
| 3,133,138 | A | 5/1964 | Alexander, Jr. | |
| 3,756,908 | A * | 9/1973 | Gross | 162/146 |
| 3,767,756 | A | 10/1973 | Blades | |
| 3,869,430 | A | 3/1975 | Blades | |
| 3,884,881 | A | 5/1975 | Bice et al. | |
| 4,472,241 | A | 9/1984 | Provost | |
| 4,698,267 | A * | 10/1987 | Tokarsky | 428/474.4 |
| 4,752,355 | A * | 6/1988 | Provost | 162/123 |
| 5,026,456 | A * | 6/1991 | Hesler et al. | 162/146 |
| 5,076,887 | A * | 12/1991 | Hendren | 162/123 |
| 5,084,136 | A | 1/1992 | Haines et al. | |
| 5,240,766 | A * | 8/1993 | Foster | 428/297.4 |
| 5,314,742 | A * | 5/1994 | Kirayoglu et al. | 442/378 |
| 5,811,042 | A | 9/1998 | Hoiness | |
| 5,833,807 | A * | 11/1998 | Ramachandran et al. | 162/157.3 |
| 6,110,991 | A * | 8/2000 | Kaminski et al. | 523/156 |
| 2002/0142689 | A1 * | 10/2002 | Levit | 442/381 |
| 2003/0022961 | A1 | 1/2003 | Kusaka et al. | |

FOREIGN PATENT DOCUMENTS

| | | |
|---|---|---|
| EP | 0 392 559 | 10/1990 |

OTHER PUBLICATIONS

Research Disclosure, Feb. 1980, pp. 74-75.

* cited by examiner

*Primary Examiner*—Jose Fortuna
*Assistant Examiner*—Dennis Cordray

(57) ABSTRACT

The present invention relates to meta- and para-aramid pulp for use as reinforcement material in products such as seals and friction materials. The pulp comprises (a) fibril free meta-aramid particles, (b) irregularly shaped, para-aramid fibrous structures, and (c) water, whereby the para-aramid fibrous structures contact and are wrapped partially around at least some of the meta-aramid particles. The invention further relates to processes for making such aramid pulp.

6 Claims, 6 Drawing Sheets

META- AND PARA-ARAMID PULP AND PROCESSES OF MAKING SAME

BACKGROUND OF THE INVENTION

1. Field of the Invention

This invention relates to meta- and para-aramid pulp for use as reinforcement material in products such as seals and friction materials. The invention further relates to processes for making such aramid pulp.

2. Description of Related Art

Fibrous and non fibrous reinforcement materials have been used for many years in friction products, sealing products and other plastic or rubber products. Such reinforcement materials typically must exhibit high wear and heat resistance.

Asbestos fibers have historically been used as reinforcement materials, but due to their health risks replacements have been made or proposed. However, many of these replacements do not perform as well as asbestos in one way or another.

Research Disclosure 74-75, published February 1980, discloses the manufacture of pulp made from fibrillated KEVLAR® brand para-aramid fibers of variable lengths and use of such pulp as a reinforcement material in various applications. This publication discloses that pulp made from KEVLAR® brand para-aramid fibers can be used in sheet products alone, or in combination with fibers of other materials, such as NOMEX® brand meta-aramid, wood pulp, cotton and other natural celluloses, rayon, polyester, polyolefin, nylon, polytetrafluoroethylene, asbestos and other minerals, fiberglass and other ceramics, steel and other metals, and carbon. The publication also discloses the use of pulp from KEVLAR® brand para-aramid fiber alone, or with KEVLAR® brand para-aramid short staple, in friction materials to replace a fraction of the asbestos volume, with the remainder of the asbestos volume being replaced by fillers or other fibers.

U.S. Pat. No. 5,811,042 (to Hoiness) discloses a composite friction or gasketing material made of a thermoset or thermoplastic matrix resin, fiber reinforcing material, and substantially fibril free aramid particles. Poly (p-phenylene terephthalamide) and poly(m-phenylene isophthalamide) are preferred fiber reinforcing materials, and the fibers can be in the form of floc or pulp.

U.S. Patent Application 2003/0022961 (to Kusaka et al.) discloses friction materials made from a friction modifier, a binder and a fibrous reinforcement made of a mixture of (a) a dry aramid pulp and (b) wet aramid pulp, wood pulp or acrylic pulp. Dry aramid pulp is defined as an aramid pulp obtained by "the dry fibrillation method". The dry fibrillation method is dry milling the aramid fibers between a rotary cutter and a screen to prepare the pulp. Wet aramid pulp is defined as an aramid pulp obtained by "the wet fibrillation method". The wet fibrillation method is milling short aramid fibers in water between two rotary discs to form fibrillated fibers and then dehydrating the fibrillated fibers, i.e., the pulp. Kusaka et al further disclose a method of mix-fibrillating fibers by first mixing plural types of organic fibers that fibrillate at a definite ratio, and then fibrillating the mixture to produce a pulp.

There is an ongoing need to provide alternative reinforcing materials that both perform well in products, such as seals and friction applications, and that are low in cost. Despite the numerous disclosures proposing lower cost alternative reinforcement materials, many of these proposed products do not adequately perform in use, cost significantly more than currently commercial products, or have other negative attributes. As such, there remains a need for reinforcement materials that exhibit high wear and heat resistance, that are comparable or less expensive than other commercially available reinforcement materials.

BRIEF SUMMARY OF THE INVENTION

The invention relates to a first embodiment of a process for making a meta- and para-aramid pulp for use as reinforcement material, comprising:

(a) combining pulp ingredients including:

(1) pieces of fibrous meta-aramid material being 10 to 90 wt % of the total solids in the ingredients, and having an average maximum dimension of no more than 50 mm;

(2) para-aramid fiber being 10 to 90 wt % of the total solids in the ingredients, and having an average length of no more than 10 cm; and (3) water being 95 to 99 wt % of the total ingredients;

(b) mixing the ingredients to a substantially uniform slurry;

(c) co-refining the slurry by simultaneously:

(1) breaking apart the fibrous meta-aramid material pieces, and cutting and/or masticating the meta-aramid material, into fibril free, fibrous and non fibrous, meta-aramid particles;

(2) fibrillating, cutting and masticating the para-aramid fiber to irregularly shaped fibrillated fibrous structures; and (3) dispersing all solids such that the refined slurry is substantially uniform; and (d) removing water from the refined slurry to no more than 60 total wt % water, thereby producing a meta- and para-aramid pulp with the para-aramid fibrous structures contacting and wrapped partially around at least some of the meta-aramid particles.

The invention is further related to a second embodiment of a process for making a meta- and para-aramid pulp for use as reinforcement material, comprising:

(a) combining ingredients including water and a first material of the group:

(1) pieces of fibrous meta-aramid material being 10 to 90 wt % of the total solids in the ingredients, and having an average maximum dimension of no more than 50 mm; and (2) para-aramid fiber being 10 to 90 wt % of the total solids in the ingredients, and having an average length of no more than 10 cm;

(b) mixing the ingredients to a substantially uniform suspension;

(c) refining the mixed suspension by:

(1) breaking apart at least some of the fibrous meta-aramid material pieces, and cutting and/or masticating at least some of the meta-aramid material, into fibril free, fibrous and non fibrous, meta-aramid particles; or (2) fibrillating, cutting and masticating at least some of the para-aramid fiber to irregularly shaped fibrillated fibrous structures;

(d) combining ingredients including the refined suspension, the second material of the group of (a)(1 and 2), and water, if necessary, to increase the water concentration to 95-99 wt % of the total ingredients;

(e) mixing the ingredients, if necessary, to form a substantially uniform slurry;

(f) co-refining the slurry by simultaneously:

(1) breaking apart at least some of the fibrous meta-aramid material pieces and/or cutting and/or masticating at least some of the meta-aramid material, such that all or substantially all of the fibrous meta-aramid material pieces are converted into fibril free, fibrous and non fibrous, meta-aramid particles; and (2) fibrillating, cutting and masticating at least some of the para-aramid fiber such that all or substantially all of the para-aramid fiber is converted to irregularly shaped fibrillated fibrous structures; and (3) dispersing all solids such that the refined slurry is substantially uniform; and (g) removing water from the refined slurry to no more than 60 total wt % water, thereby producing a meta- and para-aramid pulp with the para-aramid fibrous structures contacting and wrapped partially around at least some of the meta-aramid particles.

The invention is further directed to a meta- and para-aramid pulp for use as reinforcement material, comprising:

(a) fibril free meta-aramid particles being 10 to 90 wt % of the total solids;

(b) irregularly shaped, para-aramid fibrous structures being 10 to 90 wt % of the total solids and having stalks and fibrils; and (c) water being 4 to 60 wt % of the entire pulp, whereby the para-aramid fibrous structures contact and are wrapped partially around at least some of the meta-aramid particles.

The invention is further directed to a friction material, comprising a friction modifier; optionally at least one filler; a binder; and a fibrous reinforcement material comprising the pulp of the present invention.

Moreover, the invention is directed to a sealing material, comprising a binder; optionally at least one filler; and a fibrous reinforcement material comprising the pulp of the present invention.

BRIEF DESCRIPTION OF THE DRAWING(S)

The invention can be more fully understood from the following detailed description thereof in connection with accompanying drawings described as follows.

GLOSSARY

Figure 1:
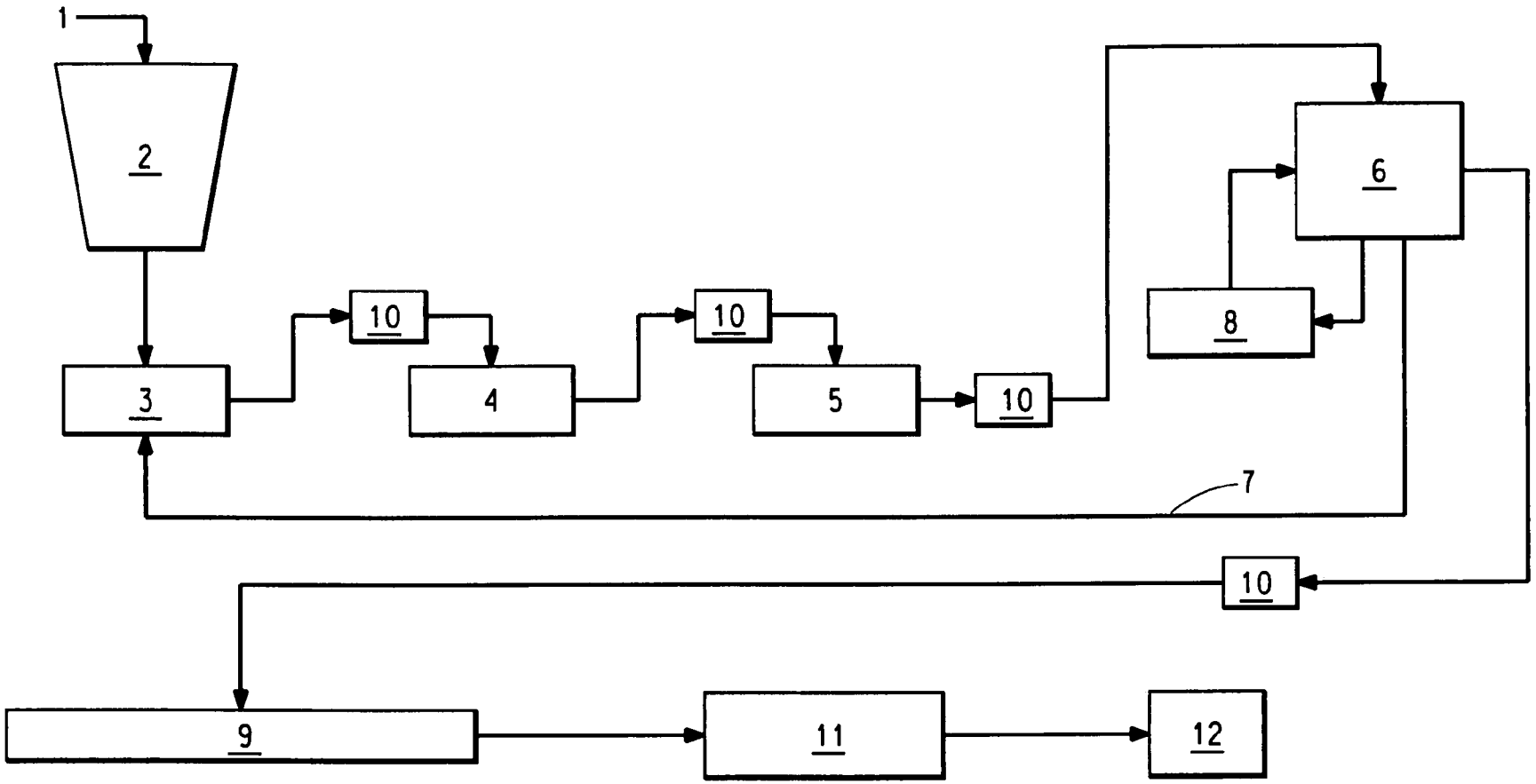
FIG. 1 is a block diagram of apparatus for performing a wet process for making "wet" aramid pulp in accordance with the present invention.

Before the invention is described, it is useful to define certain terms in the following glossary that will have the same meaning throughout this disclosure unless otherwise indicated.

"Maximum dimension" of an object means the straight distance between the two most distal points from one another in the object.

"Aspect ratio" of an object means the maximum dimension of the object, divided by the maximum width of that object in any plane containing the maximum dimension where the maximum width is perpendicular to the maximum dimension.

"Fabric" means any woven, knitted, or non-woven layer structure. By "woven" is meant any fabric makeable by weaving, that is, interlacing or interweaving at least two yarns typically at right angles. Generally such fabrics are made by interlacing one set of yarns, called warp yarns, with another set of yarns, called weft or fill yarns. The woven fabric can have essentially any weave, such as, plain weave, crowfoot weave, basket weave, satin weave, twill weave, unbalanced weaves, and the like. Plain weave is the most common. By "knitted" is meant a structure producible by interlocking a series of loops of one or more yarns by means of needles or wires, such as warp knits (e.g., tricot, milanese, or raschel) and weft knits (e.g., circular or flat). By "non-woven" is meant a network of fibers forming a flexible sheet material producible without weaving or knitting and held together by either (i) mechanical interlocking of at least some of the fibers, (ii) fusing at least some parts of some of the fibers, or (iii) bonding at least some of the fibers by use of a binder material. Non-woven includes unidirectional fabrics, felts, spunlaced fabrics, hydrolaced fabrics, spunbonded fabrics, and the like.

"Fiber" means a relatively flexible, unit of matter having a high ratio of length to width across its cross-sectional area perpendicular to its length. Herein, the term "fiber" is used interchangeably with the term "filament" or "end". The cross section of the filaments described herein can be any shape, but are typically circular or bean shaped. Fiber spun onto a bobbin in a package is referred to as continuous fiber. Fiber can be cut into short lengths called staple fiber. Fiber can be cut into even smaller lengths called floc. Yarns, multifilament yarns or tows comprise a plurality of fibers. Yarn can be intertwined and/or twisted.

"Fibrid" means non-granular, fibrous or film-like, particles. Preferably, they have a melting point or decomposition point above 320° C. Fibrids are not fibers, but they are fibrous in that they have fiber-like regions connected by webs. Fibrids have an average length of 0.2 to 1 mm with an aspect ratio of 5:1 to 10:1. The thickness dimension of the fibrid web is less than 1 or two microns and typically on the order of a fraction of a micron. Fibrids, before being dried, can be used wet and can be deposited as a binder physically entwined about other ingredients or components of a product. The fibrids can be prepared by any method including using a fibridating apparatus of the type disclosed in U.S. Pat. No. 3,018,091 where a polymer solution is precipitated and sheared in a single step.

"Fibril" means a small fiber having a diameter as small as a fraction of a micrometer to a few micrometers and having a length of from about 10 to 100 micrometers. Fibrils generally extend from the main trunk of a larger fiber having a diameter of from 4 to 50 micrometers. Fibrils act as hooks or fasteners to ensnare and capture adjacent material. Some fibers fibrillate, but others do not or do not effectively fibrillate and for purposes of this definition such fibers do not fibrillate. Poly (para-phenylene terephthalamide) fiber fibrillates readily upon abrasion, creating fibrils. Poly(meta-phenylene isophthalamide) fiber do not fibrillate.

"Fibrillated fibrous structures" means particles of material having a stalk and fibrils extending therefrom wherein the stalk is generally columnar and about 10 to 50 microns in diameter and the fibrils are hair-like members only a fraction of a micron or a few microns in diameter attached to the stalk and about 10 to 100 microns long.

"Fibrous sheet" means a sheet containing fibers, fibrils, and/or fibrids, and optionally other ingredients. Fibrous sheets can be papers or fabrics. "Papers" means flat sheets producible on a paper machine, such as a Fourdrenier or inclined-wire machine.

"Floc" means short lengths of fiber, shorter than staple fiber. The length of floc is about 0.5 to about 15 mm and a diameter of 4 to 50 micrometers, preferably having a length of 1 to 12 mm and a diameter of 8 to 40 micrometers. Floc that is less than about 1 mm does not add significantly to the strength of the material in which it is used. Floc or fiber that is more than about 15 mm often does not function well because the individual fibers may become entangled and cannot be adequately and uniformly distributed throughout the material or slurry. Aramid floc is made by cutting aramid fibers into short lengths without significant or any fibrillation, such as those prepared by processes described in U.S. Pat. Nos. 3,063,966, 3,133,138, 3,767,756, and 3,869,430.

"Length-weighted average" means the calculated length from the following formula:

$$\text{Length-weighted average} = \frac{\sum\left[(\text{Each Individual pulp length})^2\right]}{\sum\left[\text{Each Individual pulp length}\right]}$$

"Staple fiber" can be made by cutting filaments into lengths of no more than 15 cm, preferably 3 to 15 cm; and most preferably 3 to 8 cm. The staple fiber can be straight (i.e., non crimped) or crimped to have a saw tooth shaped crimp along its length, with any crimp (or repeating bend) frequency. The fibers can be present in uncoated, or coated, or otherwise pretreated (for example, pre-stretched or heat-treated) form.

DETAILED DESCRIPTION OF THE INVENTION

The invention is directed to processes for making a meta- and para-aramid pulp for use as reinforcement material. The invention is also directed to meta- and para-aramid pulp, that can be made by the processes of the invention, for use as reinforcement material. The invention is further directed to products, such as sealing materials and friction materials, incorporating the pulp of this invention, and processes for making them.

I. First Embodiment of the Inventive Process

In a first embodiment, the process for making a meta- and para-aramid pulp comprises the following steps. First, pulp ingredients are combined or added together in a container. Second, the combined pulp ingredients are mixed to a substantially uniform slurry. Third, the slurry is simultaneously refined or co-refined. Fourth, water is removed from the refined slurry.

Combining Step

In the combining step, the pulp ingredients are preferably added together in a vessel or container. The pulp ingredients include (1) pieces of fibrous meta-aramid material, (2) para-aramid fiber, (3) optionally substantially or completely fibril-free, granular, para-aramid particles, (4) optionally other minor additives, and (5) water.

Pieces of Fibrous Meta-Aramid Material

The pieces of fibrous meta-aramid material are added to a concentration of 10 to 90 wt % of the total solids in the ingredients, preferably 25 to 60 wt % of the total solids in the ingredients, and most preferably 25 to 55 wt % of the total solids in the ingredients.

The fibrous meta-aramid material preferably has an average maximum dimension of no more than 50 mm, more preferably 12 to 50 mm, and most preferably 12 to 25 mm. The pieces of fibrous meta-aramid material can be fibers, fibrids, fabric pieces, fibrous sheet pieces, pulp, or mixtures thereof. Prior to combining the pulp ingredients together, any fibers in the form of continuous filaments can be cut into shorter fibers, such as staple fibers or floc. The meta-aramid fibers are substantially or completely fibril free. The fibrous meta aramid material can include pieces of one or more layers of fabric and/or fibrous sheet.

In a preferred embodiment, the fibrous meta-aramid material includes one or more layers of fibrous meta-aramid paper where each layer comprises paper components including meta-aramid fiber and non-granular, fibrous or film-like, meta-aramid fibrids. The fibrous meta-aramid paper can be previously used paper or unused virgin paper. The paper can be taken from a roll or package or from never rolled paper or scraps generated in the manufacturing process. The fibrous meta-aramid paper layer or layers can be calendered, uncalendered, or a combination of both calendered and uncalendered paper layers. The layer or layers are preferably uncalendered and each uncalendered layer preferably has a thickness of 2 to 40 mils and a density of 0.1 to 0.4 g/cm$^3$, and more preferably a thickness of 5 to 23 mils and a density of 0.2 to 0.4 g/cm$^3$. Calendered papers may be made by calendering one or more layers together, and while there is no real maximum of the number of layers that can be combined, typically 6 or fewer are calendered together. Preferably 1 to 4 layers of uncalendered paper are calendered together to make a calendered paper. Calendered papers have a thickness of from 1 to 30 mils and a density of from 0.7 to 1.2 g/cm3, and preferably have a thickness of from 1 to 8 mils and a density of from 0.8 to 1.1 g/cm3. In one embodiment, the total paper comprises 50 wt % calendered paper and 50 wt % uncalendered paper.

In one embodiment, the meta-aramid fiber in the fibrous meta-aramid paper has a concentration of 5 to 97 wt % of the paper, a linear density of 0.5 to 10 dtex, and a length of 2 to 25 mm. More preferably, the meta-aramid fiber has a concentration of 30 to 60 wt % of the paper, a linear density of 0.5 to 5 dtex, and a length of 2 to 8 mm. In this same embodiment, the non granular, fibrous or film-like, meta-aramid fibrids in the fibrous meta-aramid paper has a concentration of 3 to 95 wt % of the paper, an average maximum dimension of 0.2 to 1 mm, an aspect ratio of 5:1 to 10:1, and a thickness of no more than 1 micron. More preferably, the meta-aramid fibrids have a concentration of 40 to 70 wt % of the paper, and a thickness of 0.1-0.5 micron.

Figure 3:
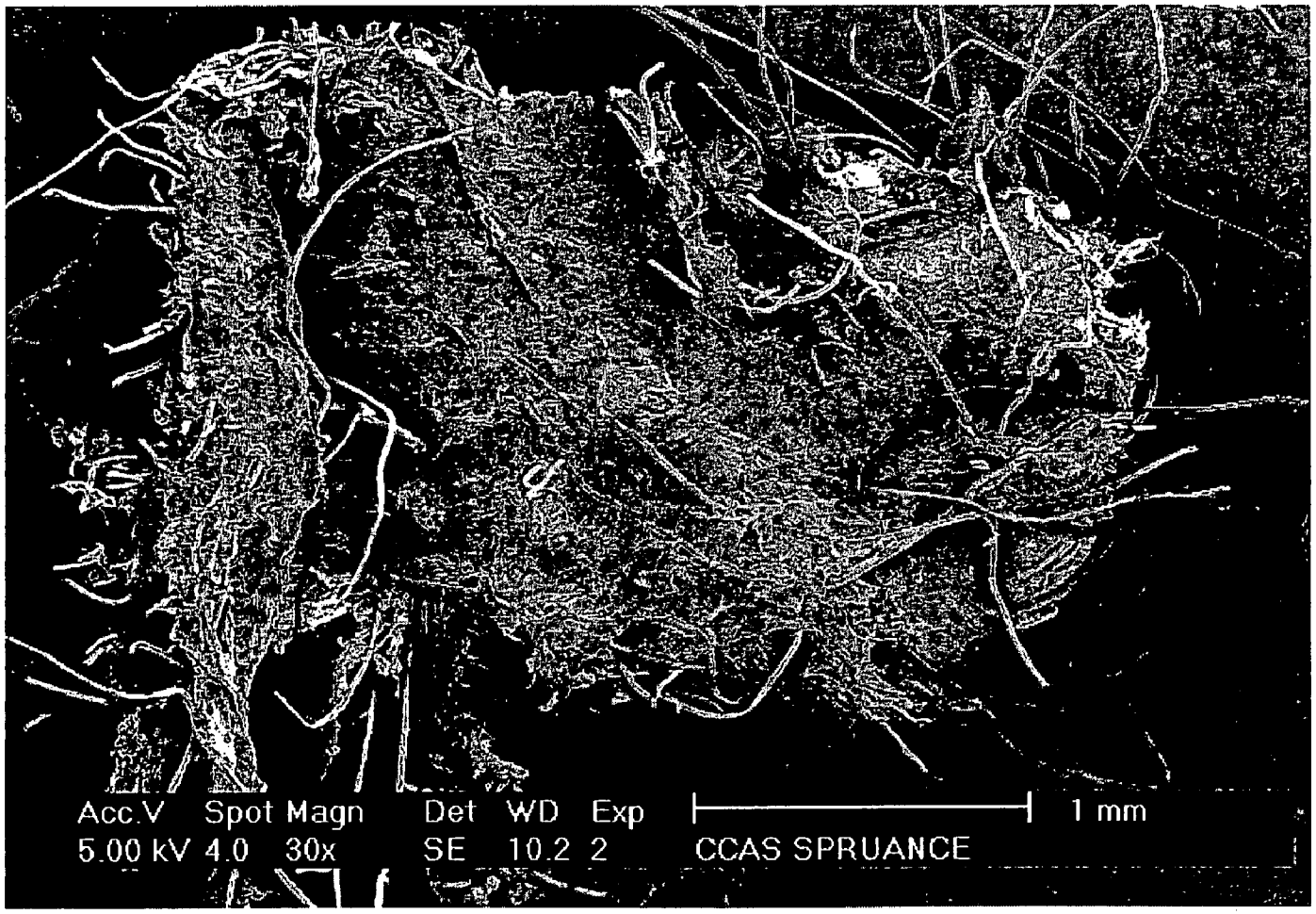
FIG. 3 is an image of a photomicrograph of pieces of meta-aramid material used as an ingredient to the process of the present invention.

FIG. 3 is an image of a photomicrograph of pieces of meta-aramid material comprising meta-aramid floc and non-granular, fibrous or film-like, meta-aramid fibrids suitable for use as ingredients to the process of the present invention.

In another embodiment, the fibrous meta-aramid material can include, in addition to non-granular, fibrous or film-like, meta-aramid fibrids, para-aramid floc. These two ingredients, meta-aramid fibrids and para-aramid floc, can be obtained from pieces of one or more layer of THERMOUNT® brand aramid paper.

Para-Aramid Fiber

The para-aramid fiber is added to a concentration of 10 to 90 wt % of the total solids in the ingredients, preferably 40 to 75 wt % of the total solids in the ingredients, and most preferably 40 to 55 wt % of the total solids in the ingredients.

Figure 4:
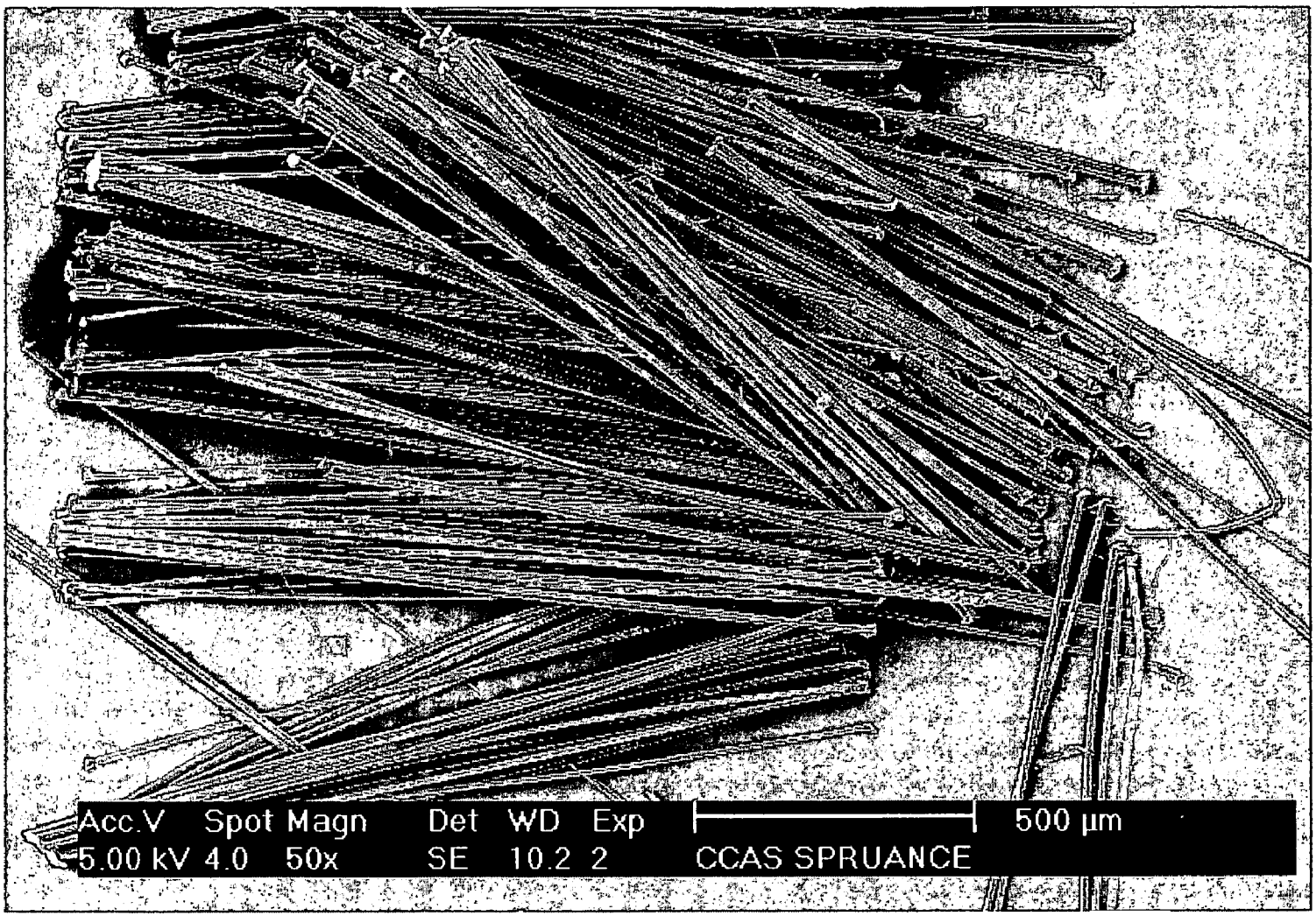
FIG. 4 is an image of a photomicrograph of para-aramid fiber used as an ingredient to the process of the present invention.

The para-aramid fiber preferably has a linear density of no more than 10 dtex, more preferably 0.5 to 10 dtex, and most preferably, 0.8 to 2.5 dtex. The para-aramid fiber also preferably has an average length along its longitudinal axis of no more than 10 cm, more preferably an average length of 0.65 to 2.5 cm, and most preferably an average length of 0.65 to 1.25 cm. FIG. 4 is an image of a photomicrograph of para-aramid floc capable of being used as an ingredient to the process of the present invention.

Para-Aramid Particles

Figure 5:
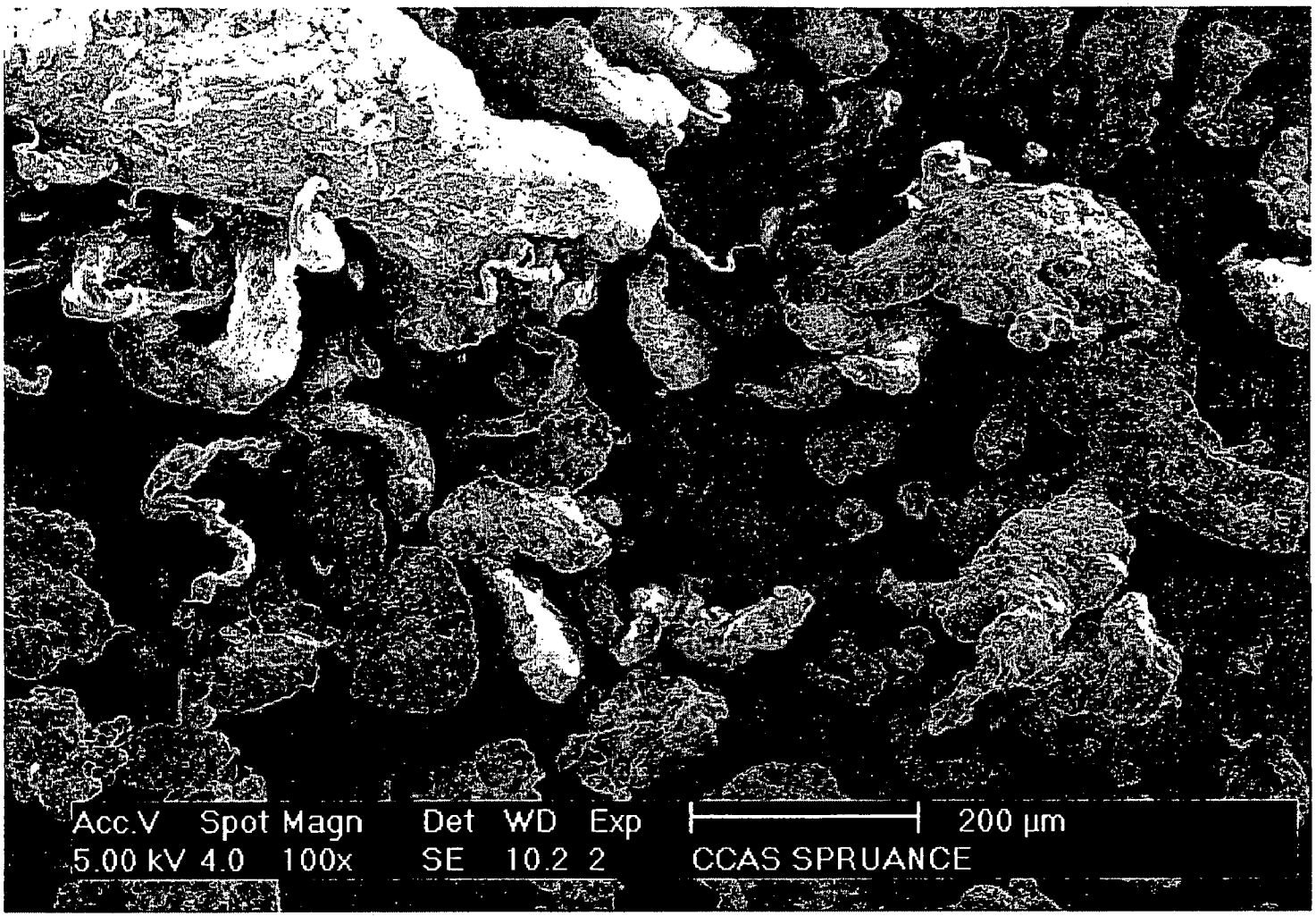
FIG. 5 is an image of a photomicrograph of para-aramid particles used as an optional ingredient to the process of the present invention.

Optionally, in one embodiment, the pulp ingredients further include substantially or completely fibril-free, granular, para-aramid particles. If such particles are added, they are added to a concentration of no more than 50 wt % of the total solids in the ingredients, preferably 20 to 50 wt % of the total solids in the ingredients, and most preferably 25 to 35 wt % of the total solids in the ingredients. These particles have relatively low surface area compared to fibers or fibrids of equal weight. Being made of para-aramid, they contribute superior wear resistance and dispersability to the pulp being produced. Because the particles are substantially fibril-free, they also serve as a compounding agent to assist in dispersing the other ingredients in the mixture and slurry. Particles that perform this function are often known as processing agents or aids. The substantially or completely fibril-free, granular, para-aramid particles have an average maximum dimension of 50 to 2000 microns, preferably 50 to 1500 microns, and most preferably 75 to 1000 microns. Particles below about 50 microns, however, lose effectiveness in friction and sealing applications. Particles above about 2000 microns do not adequately stay dispersed in the water with other the ingredients when mixed. FIG. 5 is an image of a photomicrograph of para-aramid particles capable of being used as ingredients to the process of the present invention.

In one preferred embodiment, the total solid ingredients can include 28 wt % pieces of fibrous meta-aramid material, 44 wt % para-aramid fiber, and 28 wt % para-aramid particles.

Polymer

Polymers suitable for use in making the aramid material, aramid fiber and aramid particles of this invention are synthetic aromatic polyamides. The polymers must be of fiber-forming molecular weight in order to be shaped into fibers. The polymers can include polyamide homopolymers, copolymers, and mixtures thereof which are predominantly aromatic, wherein at least 85% of the amide (—CONH—) linkages are attached directly to two aromatic rings. The rings can be unsubstituted or substituted. The polymers are meta-aramid when the two rings or radicals are meta oriented with respect to each other along the molecular chain. The polymers are para-aramid when the two rings are para oriented with respect to each other along the molecular chain. Preferably copolymers have no more than 10 percent of other diamines substituted for a primary diamine used in forming the polymer or no more than 10 percent of other diacid chlorides substituted for a primary diacid chloride used in forming the polymer. Additives can be used with the aramid; and it has been found that up to as much as 13 percent by weight of other polymeric material can be blended or bonded with the aramid. The preferred para-aramids are poly(para-phenylene terephthalamide)(PPD-T) and its copolymers. The preferred meta-aramids are poly(meta-phenylene isophthalamide)(MPD-I) and its copolymers.

Optional Other Additives

Other additives can optionally be added as long as they stay suspended in solution in the mixing step and do not significantly change the effect of the refining step on the mandatory solid ingredients listed above. Suitable additives include pigments, dyes, anti-oxidants, flame-retardant compounds, and other processing and dispersing aids. Preferably, the pulp ingredients do not include asbestos. In other words, the resulting pulp is asbestos free or without asbestos.

Water

Water is added to a concentration of 95 to 99 wt % of the total ingredients, and preferably 97 to 99 wt % of the total ingredients. Further, the water can be added first. Then other ingredients can be added at a rate to optimize dispersion in the water while simultaneously mixing the combined ingredients.

Mixing Step

In the mixing step, the ingredients are mixed to a substantially uniform slurry. By "substantially uniform" is meant that random samples of the slurry contain the same wt % of the concentration of each of the starting ingredients as in the total ingredients in the combination step plus or minus 10 wt %, preferably 5 wt % and most preferably 2 wt %. For instance, if the concentration of the solids in the total mixture is 50 wt % pieces of fibrous meta-aramid material plus 50 wt % para-aramid fiber, then a substantially uniform mixture in the mixing step means each random sample of the slurry has (1) a concentration of the meta-aramid material of 50 wt % plus or minus 10 wt %, preferably 5 wt % and most preferably 2 wt % and (2) a concentration of para aramid fiber of 50 wt % plus or minus 10 wt %, preferably 5 wt % and most preferably 2 wt %. The mixing can be accomplished in any vessel containing rotating blades. The mixing can occur after the ingredients are added or while the ingredients are being added or combined.

Refining Step

In the refining step the pulp ingredients are simultaneously co-refined, converted or modified as follows. The fibrous meta-aramid material pieces are broken apart, and cut and/or masticated, into fibril free, fibrous and non fibrous, meta-aramid particles. The para-aramid floc is fibrillated, cut and masticated to irregularly shaped fibrous structures having stalks and fibrils. If para-aramid particles are added with the other ingredients, at least some of the para-aramid particles are masticated into smaller, rounder, substantially fibril-free, particles. All solids are dispersed such that the refined slurry is substantially uniform. "Substantially uniform" is as defined above. The refining step preferably comprises passing the mixed slurry through one or more disc refiner, or recycling the slurry back through a single refiner. By the term "disc refiner" is meant a refiner containing one or more pair of discs that rotate with respect to each other thereby refining ingredients by the shear action between the discs. In one suitable type of disc refiner, the slurry being refined is pumped between closely spaced circular rotor and stator discs rotatable with respect to one another. Each disc has a surface, facing the other disc, with at least partially radially extending surface grooves. A preferred disc refiner that can be used is disclosed in U.S. Pat. No. 4,472,241. If necessary for uniform dispersion and adequate refining, the mixed slurry can be passed through the disc refiner more than once or through a series of at least two disc refiners. When the mixed slurry is refined in only one refiner, there is a tendency for the resulting slurry to be inadequately refined and non uniformly dispersed. Conglomerates or aggregates entirely or substantially of one solid ingredient, or the other, or both, or all three if three are present, can form rather than being dispersed forming a substantially uniform dispersion. Such conglomerates or aggregates have a greater tendency to be broken apart and dispersed in the slurry when the mixed slurry is passed through the refiner more than once or passed through more than one refiner.

Because a substantially uniform slurry containing multiple ingredients is co-refined in this step of the process, any one type of non-pulp ingredient (for example, para-aramid fiber) is refined into a pulp in the presence of all the other types of non-pulp ingredients (for example, aramid material pieces and optionally para-aramid particles) while those other ingredients are also being refined. This co-refining of non-pulp ingredients forms a pulp that is superior to a pulp blend generated by merely mixing two pulps together. Adding two pulps and then merely mixing them together does not form the substantially uniform, intimately connected, fibrous components of the pulp generated by co-refining of non-pulp ingredients into pulp in accordance with the present invention.

Removing Step

Then water is removed from the refined slurry to no more than 60 total wt % water, preferably 4 to 60 total wt % water, most preferably, 5 to 58 total wt % water. The water can be removed by collecting the pulp on a dewatering device such as a horizontal filter, and if desired, additional water can be removed by applying pressure or squeezing the pulp filter cake. The dewatered pulp can optionally then be dried to a desired moisture content, and/or can be packaged or wound up on rolls.

Figure 2:
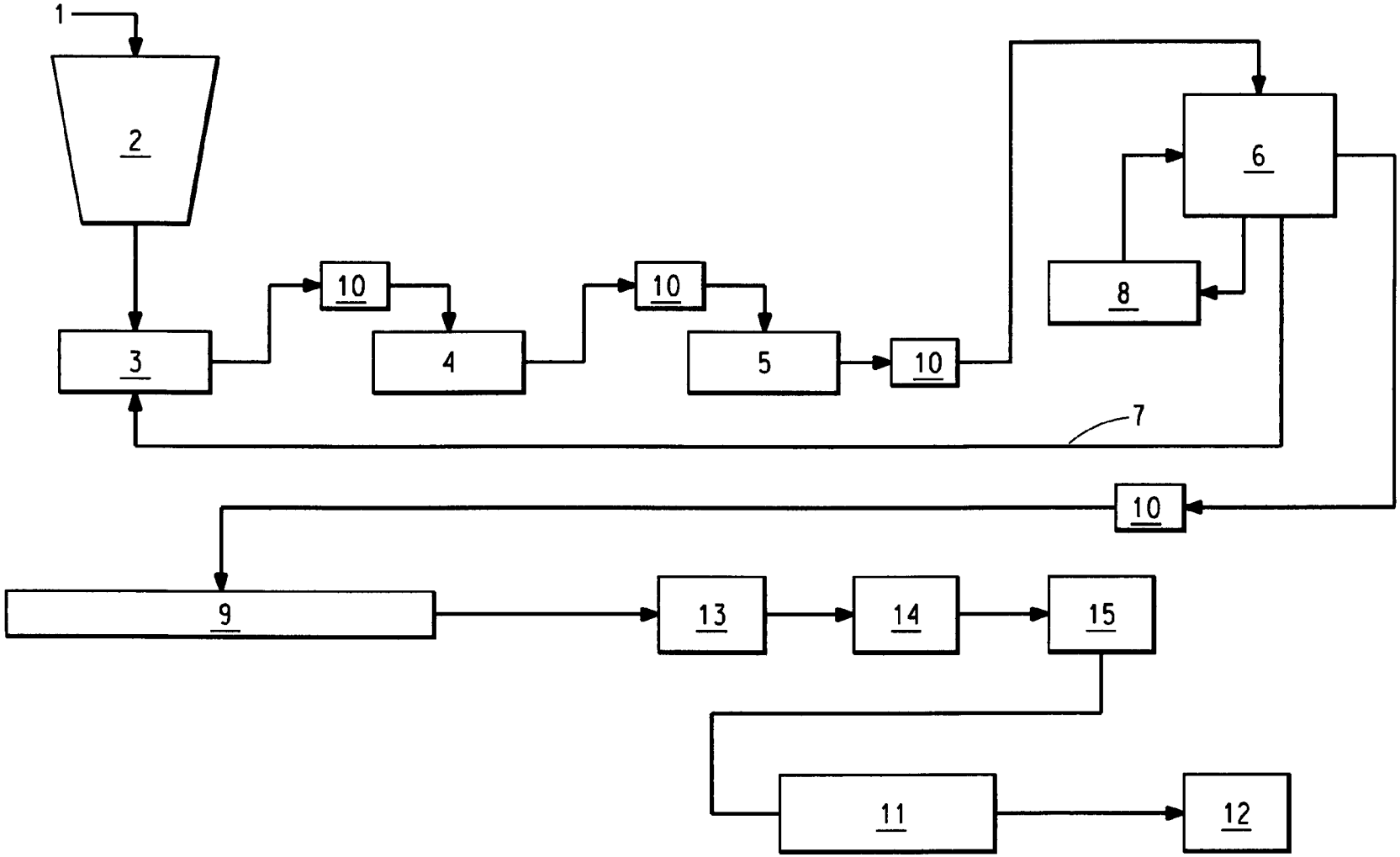
FIG. 2 is a block diagram of apparatus for performing a dry process for making "dry" aramid pulp in accordance with the present invention.

FIGS. 1 and 2

This process will now be described in reference to FIGS. 1 and 2. Throughout this detailed description, similar reference characters refer to similar elements in all figures of the drawings.

Referring to FIG. 1, there is a block diagram of an embodiment of a wet process for making "wet" aramid pulp in accordance with the present invention. Pulp ingredients 1 are added to container 2. Container 2 is provided with an internal mixer, similar to a mixer in a washing machine. The mixer disperses the ingredients into the water creating the substantially uniform slurry. The mixed slurry is transferred to a first refiner 3 which refines the slurry. Then, optionally, the refined slurry can be transferred to a second refiner 4, and optionally then to a third refiner 5. Three refiners are illustrated but any number of refiners can be used depending on the degree of uniformity and refining desired. After the last refiner in the series of refiners, the refined slurry is optionally transferred to a filter or sorter 6 that allows slurry with dispersed solids below a chosen mesh or screen size to pass and recirculates dispersed solids larger than a chosen mesh or screen size back to one or more of the refiners such as through line 7 or to a refiner 8 dedicated to refine this recirculated slurry from which refined slurry is again passed to the filter or sorter 6. Suitably refined slurry passes from the filter or sorter 6 to a horizontal water vacuum filter 9 which removes water such that the pulp has a concentration of water of no more than 75 wt % of the total ingredients. Slurry can be transferred from point to point by any conventional method and apparatus such as with the assistance of one or more pump 10. Then the pulp is conveyed to a dryer 11 that removes more water until the pulp has a concentration of water of no more than 60 wt % of the total ingredients. Then the refined pulp is packaged in a baler 12.

Referring to FIG. 2, there is a block diagram of an embodiment of a dry process for making "dry" aramid pulp in accordance with the present invention. This dry process is the same as the wet process except after the horizontal water vacuum filter 9. After that filter, the pulp goes through a press 13 which removes more water until the pulp has a concentration of water of no more than 20 wt % of the total ingredients. Then the pulp goes through a fluffer 14 to fluff the pulp and then a rotor 15 to remove more water. Then, like the wet process, the pulp is passed through a dryer 11 and packaged in a baler 12.

II. Second Embodiment of the Inventive Process

In a second embodiment, the process for making the meta- and para-aramid pulp is the same as the first embodiment of the process described above with the following differences. Instead of combining all the pulp ingredients together at once, the ingredients can be added in stages. For instance, some or all of the water needed for all ingredients can be combined with either the (i) pieces of fibrous meta-aramid material or the (ii) para-aramid floc. These ingredients are mixed to a first substantially uniform suspension. Then the suspension is refined. If the suspension includes pieces of fibrous meta-aramid material, the refining includes breaking apart at least some of the fibrous meta-aramid material pieces, and cutting and/or masticating at least some of the meta-aramid material, into fibril free, fibrous and non fibrous, meta-aramid particles. If the suspension includes para-aramid fiber, the refining includes fibrillating, cutting and masticating at least some of the para-aramid fiber to irregularly shaped fibrillated fibrous structures. Then, more water is added, if necessary, to increase the water content to 95-99 wt % of the total ingredients. The other ingredient, that was not previously added, of the (i) pieces of fibrous meta-aramid material or the (ii) para-aramid fiber is now added. If water is added, this other ingredient can be added before, after or with the additional water. Then, all ingredients are mixed, if necessary, to form a substantially uniform slurry. The slurry is then co-refined together, i.e., simultaneously. If some meta-aramid material was refined in the first refining step, this co-refining step includes breaking apart at least some of the fibrous meta-aramid material pieces and/or cutting and/or masticating at least some of the meta-aramid material, such that all or substantially all of the fibrous meta-aramid material pieces are converted into fibril free, fibrous and non fibrous, meta-aramid particles. If some para-aramid fiber was refined in the first refining step, this second refining step includes fibrillating, cutting and masticating at least some of the para-aramid fiber such that all or substantially all of the para-aramid fiber is converted to irregularly shaped fibrillated fibrous structures. This co-refining step also includes dispersing all solids such that the refined slurry is substantially uniform. Then water is removed as in the first embodiment of the process. Both processes produce the same or substantially the same meta- and para-aramid pulp.

The Inventive Pulp

The resulting product produced by the process of this invention is a meta- and para-aramid pulp for use as reinforcement material in products. The pulp comprises (a) fibril free, fibrous and non-fibrous, meta-aramid particles, (b) irregularly shaped, para-aramid fibrous structures, (c) optionally substantially fibril-free, granular, para-aramid particles, (d) optionally other minor additives, and (e) water.

The concentration of the separate solid ingredient components in the pulp correspond, of course, to the concentrations described beforehand of the corresponding solid ingredients used in making the pulp. Preferably, the fibril free, fibrous and non-fibrous, meta-aramid particles and the irregularly shaped, para-aramid fibrillated fibrous structures have a length weighted average of no more than 1.3 mm.

The fibril free, fibrous and non-fibrous, meta-aramid particles preferably have an average maximum dimension of no more than 10,000 microns, more preferably, 50 to 7,500 microns, and most preferably 50 to 5,000 microns.

The irregularly shaped, para-aramid fibrillated fibrous structures have stalks and fibrils. The fibrils are important and act as hooks or fasteners or tentacles which adhere to and hold adjacent particles in the pulp and final product thereby providing integrity to the final product. The para-aramid fibrillated fibrous structures preferably have an average maximum dimension of no more than 5 mm, more preferably 0.1 to 5 mm, and most preferably 0.1 to 3 mm. The para-aramid fibrous structures contact and are wrapped partially around at least some of the meta-aramid particles.

If para-aramid particles are included in the pulp, the para-aramid fibrous structures also additionally contact and are wrapped partially around at least some of these rounder, substantially fibril-free, para-aramid particles. These para-aramid particles preferably have an average maximum dimension of at least 50 microns, more preferably, 50 to 100 microns, and most preferably 50 to 75 microns. Where the para-aramid fibrous structures contact and are wrapped partially around the meta-aramid particles (and, if present, the para-aramid particles) the two components can contact at more than one point; they can, but do not need to continuously contact one another along the entire curved path between the components. For instance, fibrils on and along the para-aramid fibrous structures can contact and form a partial cocoon around the meta-aramid particles (and, if present, the rounder, substantially fibril-free, para-aramid particles) where the para-aramid fibrous structures partially wrap around the meta-aramid particles (and, if present, the rounder, substantially fibril-free, para-aramid particles). Preferably, the para-aramid fibrous structures contact and are wrapped partially around at least 25%, preferably 50%, and most preferably 75% of the meta-aramid particles (and, if present, the rounder, substantially fibril-free, para-aramid particles).

The meta- and para-aramid pulp has a Canadian Standard Freeness (CSF) as measured per TAPPI test T 227om-92, which is a measure of its drainage characteristics, of 100 to 700 ml, and preferably 250 to 450 ml.

Surface area of pulp is a measure of the degree of fibrillation and influences the porosity of the product made from the pulp. Preferably, the surface area of pulp of this invention is 7 to 11 square meters per gram.

Figure 6:
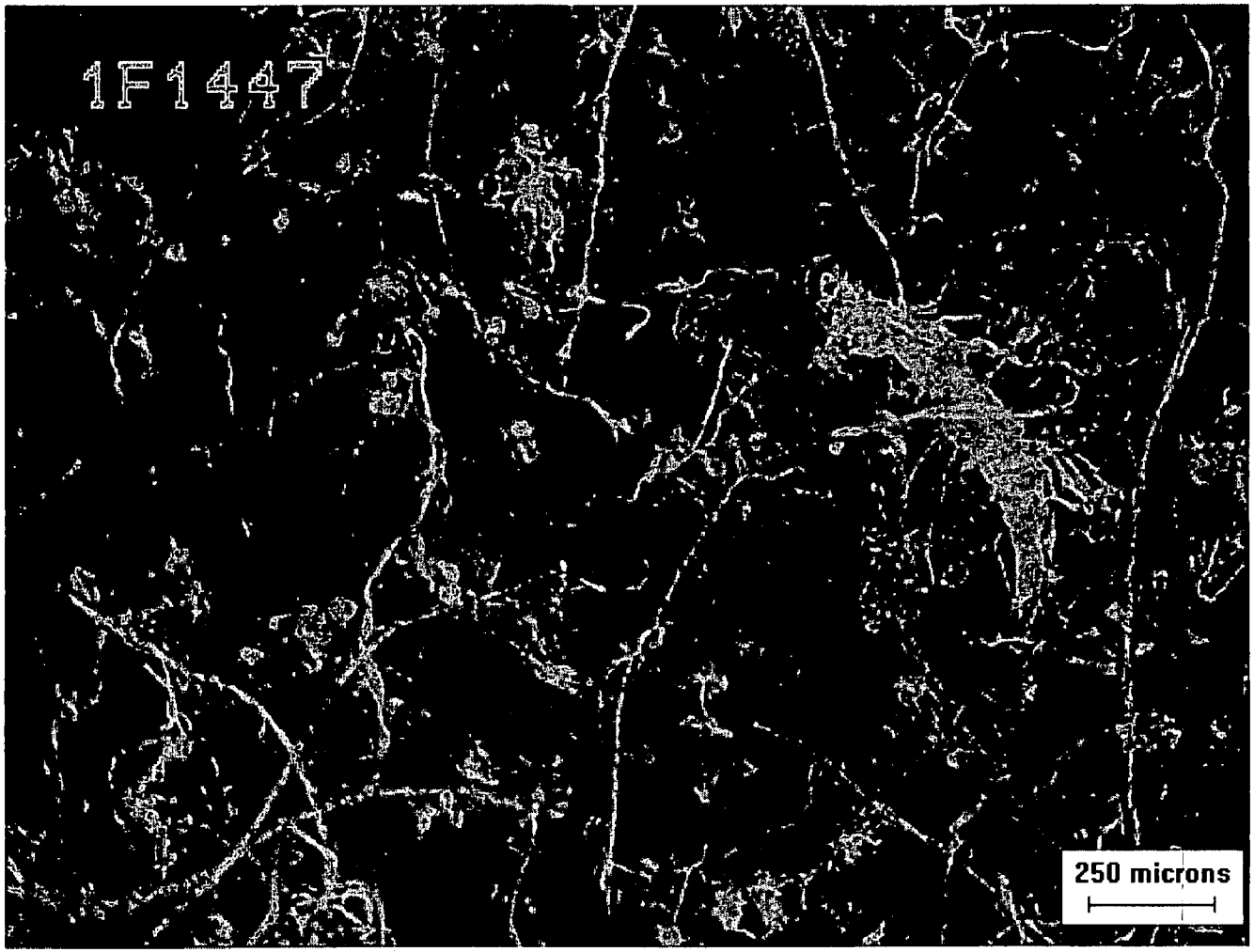
FIG. 6 is an image of a photomicrograph of aramid pulp made according to the process of the present invention.

FIG. 6 is an image of a photomicrograph of meta- and para-aramid pulp made according to the process of the present invention.

It is believed that aramid particles and fibrous structures, dispersed substantially homogeneously throughout the reinforcement material, and the friction and sealing materials, provide, by virtue of the high temperature characteristics of the meta- and para-aramid polymers and the fibrillation propensity of the para-aramid polymer, many sites of reinforcement and increased wear resistance. When co-refined, the blending of the aramid materials is so intimate that in a friction or sealing material there is always some para-aramid fibrous structures close to the meta-aramid particles, so the stresses and abrasion of service are always shared.

Sealing Material

The invention is further directed to sealing material and processes for making the sealing materials. Sealing materials are used in or as a barrier to prevent the discharge of fluids and/or gases and used to prevent the entrance of contaminants where two items are joined together. An illustrative use for sealing material is in gaskets. The sealing material comprises a binder; optionally at least one filler; and a fibrous reinforcement material comprising the meta- and para-pulp of this invention. Suitable binders include nitrile rubber, butadiene rubber, neoprene, styrene-butadiene rubber, nitrile-butadiene rubber, and mixtures thereof. The binder can be added with all other starting materials. The binder is typically added in the first step of the gasket production process, in which the dry ingredients are mixed together. Other ingredients optionally include uncured rubber particles and a rubber solvent, or a solution of rubber in solvent, to cause the binder to coat surfaces of the fillers and pulp. Suitable fillers include barium sulfate, clays, talc, and mixtures thereof.

Suitable processes for making sealing materials are, for example, a beater-add process or wet process where the gasket is made from a slurry of materials, or by what is called a calendering or dry process where the ingredients are combined in an elastomeric or rubber solution.

Friction Material

The pulp of the present invention can be used as a reinforcement material in friction materials. By "friction materials" is meant materials used for their frictional characteristics such as coefficient of friction to stop or transfer energy of motion, stability at high temperatures, wear resistance, noise and vibration damping properties, etc. Illustrative uses for friction materials include brake pads, brake blocks, dry clutch facings, clutch face segments, brake pad backing/insulating layers, automatic transmission papers, and friction papers.

In view of this new use, the invention is further directed to friction material and processes for making the friction material. Specifically, the friction material comprises a friction modifier; optionally at least one filler; a binder; and a fibrous reinforcement material comprising the meta- and para-pulp of this invention. Suitable friction modifiers are metal powders such as iron, copper and zinc; abrasives such as oxides of magnesium and aluminum; lubricants, such as synthetic and natural graphites, and sulfides of molybdenum and zirconium; and organic friction modifiers such as synthetic rubbers and cashew nut shell resin particles. Suitable binders are thermosetting resins such as phenolic resins (i.e., straight (100%) phenolic resin and various phenolic resins modified with rubber or epoxy), melamine resins, epoxy resins and polyimide resins, and mixtures thereof. Suitable fillers include barite, calcium carbonate, wollastonite, talc, various clays, and mixtures thereof.

The actual steps for making the friction material can vary, depending on the type of friction material desired. For example, methods for making molded friction parts generally involve combining the desired ingredients in a mold, curing the part, and shaping, heat treating and grinding the part if desired. Automotive transmission and friction papers generally can be made by combining the desired ingredients in a slurry and making a paper on a paper machine using conventional paper making processes.

Test Methods

The following test methods were used in the following Examples.

Canadian Standard Freeness (CSF) is a well-known measure of the facility for water to drain from a slurry or dispersion of particles. Freeness is determined by TAPPI test T227. Data obtained from conduct of that test are expressed as Canadian Standard Freeness Numbers, which represent the milliliters of water which drain from an aqueous slurry under specified conditions. A large number indicates a high freeness and a high tendency for water to drain. A low number indicates a tendency for the dispersion to drain slowly. The freeness is inversely related to the degree of fibrillation of the pulp, since greater numbers of fibrils reduce the rate at which water drains through a forming paper mat.

Length-weighted average is measured using a "FiberExpert" tabletop analyzer (also now known as "PulpExpertFS", available from Metso Automation of Helsinki, Finland). This analyzer takes photographic images of the pulp with a digital CCD camera as the pulp slurry flows through the analyzer and then an integrated computer analyzes the fibers in these images and calculates their length-weighted average.

Temperature: All temperatures are measured in degrees Celsius (° C.).

Denier is measured according to ASTM D 1577 and is the linear density of a fiber as expressed as weight in grams of 9000 meters of fiber. The denier is measured on a Vibroscope from Textechno of Munich, Germany. Denier times (10/9) is equal to decitex (dtex).

EXAMPLES

This invention will now be illustrated by the following specific examples. All parts and percentages are by weight unless otherwise indicated. Examples prepared according to the process or processes of the current invention are indicated by numerical values.

Example 1

In this example of the invention, the pulp of this invention was produced from a feedstock of meta-aramid paper, para-aramid fiber, and para-aramid resin particles. The meta-aramid paper was fed into a Retech RG52/100 rotary grinder (available from Vecoplan, LLC., with offices in Archdale, N.C.) that cut the paper into postage-stamp size pieces that passed through a ¾ inch (19 mm) screen size.

A portion of the para-aramid fiber, which was originally on bobbins, was prepared by cutting the para-aramid yarn to a nominal ½ inch (1.27 cm) cut length on a Lummus Cutter (available from Lummus Industries with offices in Columbus, Ga.). The other portion of the para-aramid fiber, which originally was not on bobbins and of multiple long lengths, was prepared by being guillotine-cut two to three times at right angles in order to produce a random-length fiber with most fibers shorter than ¾ inch (1.91 cm) and averaging about ½ inch (1.27 cm) long.

The para-aramid resin particles were prepared by reacting para-phenylenediamine and teraphthaloylchloride continuously in a screw extruder as is generally disclosed in U.S. Pat. No. 3,884,881, but using N, methyl pyrollidone/calcium chloride as the solvent to produce a crumb-like polymer that was precipitated from the solvent. The solvent was extracted, and the polymer crumb was washed and dried to a particulate powder of mixed particle size.

The three ingredients prepared as described above plus water were then combined into a highly agitated mixing tank called a hydrapulper at a concentration of 44 wt % para-aramid fiber, 28 wt % meta-aramid material (i.e., 14 wt % pieces of calendered meta-aramid paper plus 14 wt % of uncalendered meta-aramid paper), and 28 wt % para-aramid particles, and mixed to form a substantially uniform, pumpable slurry of about 2-3 wt % of the total solids concentration. The slurry was pumped through a series of three refiners, such as those described in U.S. Pat. No. 4,472,241. The refiners simultaneously:

(1) broke apart the fibrous meta-aramid paper pieces, and cut and/or masticated the meta-aramid paper pieces into meta-aramid particles;

(2) fibrillated, cut and masticated the para-aramid fiber into irregularly shaped fibrous structures having stalks and fibrils;

(3) masticated the para-aramid particles into smaller, rounder, substantially fibril-free, particles; and (4) dispersed all solids such that the refined slurry was substantially uniform. "Substantially uniform" is as defined above.

This refined slurry was then dewatered using a horizontal filter and dried in an oven to a desired moisture content of 50 total wt % for wet pulp. The wet pulp was then packaged into bales by a baler. When measured by FiberExpert®, all of the ingredients in the pulp had a length-weighted average of no more than 1.3 mm.

Example 2

The procedure of Example 1 was followed, however, after the pulp was dewatered on the horizontal filter, the pulp was pressed by a mechanical press to further remove water and then fluffed using a Fluffer available from Bepex Corporation with offices at Santa Rosa, Calif., to better separate the pressed wet pulp. The fluffed wet pulp was then dried in an oven to approximately 8 total wt % moisture and then further processed in an ultrarotor as is disclosed in U.S. Pat. No. 5,084,136 to further fluff and disperse the dried pulp. The ultrarotor that was used was an ultrarotor model IIIA available from Altenburger Machinen Jackering GmbH with offices in Voisterhauser, Germany. The dried pulp was then packaged into bales.

Example 3

Disc brake pads incorporating the pulp of this invention were made in the following manner. Approximately 20 kilograms of a non-asbestos-containing base compound powder comprising a mixture of 7 wt % cashew nut shell resin, 17 wt % inorganic fillers, 21 wt % graphite, coke and lubricants, 18 wt % inorganic abrasives, and 16 wt % soft metals were mixed together for 10 to 20 minutes in a 50-liter Littleford mixer. The mixer had two high-speed choppers with blades of the "stars and bars" configuration and a slower rotating plough.

5 kilograms of the well-blended base compound powder was then combined with the pulp of this invention (a co-refined pulp being 50 wt % para-aramid and 50 wt % meta-aramid) in an amount of 3.8 wt %, based on the combined weight of the compound and the pulp. The pulp was then dispersed in the base compound by mixing for an additional 5 to 10 minutes. Once mixed, the resulting brake pad composition had a normal visual appearance with the fiber well dispersed in and completely coated with the base compound powders, with essentially no detectable balling up of the pulp or segregation of any constituents.

The brake pad composition was then poured into a single-cavity steel mold for a front disc brake pad and cold pressed to a standard thickness of about ⅝ inch (16 mm) then removed from the mold to form a pre-formed brake pad having an approximate weight of 200 grams. The pre-form had no excessive spring-back or swelling, and was robust enough to endure normal handling without damage. Twelve replicate pre-forms were made. The pre-forms were then placed in two multi-cavity molds, placed in a commercial press, and press-cured (the binder phenolic cross-linking and reacting) at 300° F. (149° C.) for about 15 minutes, with periodic pressure release to allow phenolic reaction gases to escape, followed by lightly constrained oven curing at 340° F. (171° C.) for 4 hours to complete the phenolic binder crosslinking. The cured, molded pad was then ground to the desired thickness of about half an inch (13 mm). When compared visually with a commercial brake pad containing an equivalent amount of all para-aramid pulp or acrylic pulp, the test pad was indistinguishable and had good compound flow into the backing plate holes and no edge chipping.

A sample of the brake pad incorporating the pulp of this invention was then tested to determine its frictional performance. Coupons, typically one inch by one inch and about 3/16 inch (5 mm) thick, from test pads were assessed on the Chase Machine available from Link Engineering, Detroit, Mich., using test protocol Society of Automotive Engineers (SAE) J661 to determine the hot and cold friction coefficient during constant pressure and controlled temperature drag tests against a heated steel drum. The sample was periodically measured for wear (thickness loss). This was repeated with two more test samples cut from other replicate pads. The samples of the brake pad incorporating the pulp of this invention exhibited hot and cold friction performance substantially equivalent to commercially available pads containing an equivalent amount of all para-aramid pulp. The test of the samples of the brake pads incorporating the pulp of this invention further indicated the pad-to-pad uniformity and an average friction rating was also substantially equivalent to brake pads containing a substantially equivalent amount of all para-aramid pulp.

The pad was then tested for friction and wear under various braking conditions using a dynamometer (single piston dynamometer with a rolling radius of 289.0 mm at Link Testing Laboratories, Inc in Detroit, Mich.) using test protocol J2681 (ISO-SWG4). This test was comprised of seventeen scenarios of from 5 to 200 brake applications each, and measured coefficient of friction as a function of applied brake pressure, temperature, braking speed and deceleration rate. This test also had two high-temperature fade sections, during which the brake pad was subjected to increasingly high initial temperatures during constant deceleration, and reached temperatures exceeding 600° C. Results for the pads made with the pulp of this invention in this example showed very little fade and what fade there was recovered well (where fade is defined as the loss of friction at the highest temperature brake applications), acceptable coefficient of friction of 0.25 to 0.4 in non-fade sections, absence of pad surface cracking, and acceptable wear rates for both the pad and the rotor.

Example 4

This example illustrates how the pulp of this invention can be incorporated into a beater-add gasket for sealing applications. Water, rubber, latex, fillers, chemicals, and the pulp of this invention are combined in desired amounts to form a slurry. In this example, the pulp is made of 50 wt % of pieces of meta-aramid uncalendered paper plus 50 wt % para-aramid fiber. On a circulating wire sieve (such as a paper machine screen or wire), the slurry is largely drained of its water content, is dried in a heating tunnel, and is vulcanized on heated calender rolls to form a material having a maximum thickness of around 2.0 mm.

Such beater-add gasket materials generally do not have as good sealability as equivalent compressed-fiber materials and are best suited for moderate-pressure high-temperature applications. Beater-add gaskets find applicability in the making of auxiliary engine gaskets or, after further processing, cylinder head gaskets. For this purpose, the semi-finished product is laminated onto both sides of a spiked metal sheet and is physically fixed in place by the spikes.

Example 5

This example illustrates how the pulp of this invention can be incorporated into a gasket made by the calendering process. The same ingredients as in Example 4, minus the water, are thoroughly mixed together and are then blended with a rubber solution prepared using an appropriate solvent.

After mixing, the compound is then generally conveyed batchwise to a roll calender. The calender consists of a small roll that is cooled and a large roll that is heated. The compound is fed and drawn into the calender nip by the rotary movement of the two rolls. The compound will adhere and wrap itself around the hot lower roll in layers generally about 0.02 mm thick, depending on the pressure, to form a gasketing material made from the built-up compound layers. In so doing, the solvent evaporates and vulcanization of the elastomer commences. The evaporation rate of the solvent is dependent on the speed of the heated roll; if the speed is too fast, the solvent cannot adequate escape before the next layer of compound is applied, causing blisters in the gasketing material. If the speed is too slow, the material may be too dry to form a adequate bond between successive layers of the gasketing material and delamation can occur.

Once the desired gasketing material thickness is reached, the rolls are stopped and the gasketing material is cut from the hot roll and cut and/or punched to the desired size. No additional pressing or heating is required, and the material is ready to perform as a gasket. In this manner gaskets up to about 7 mm thick can be manufactured. However, most gaskets made in this manner are much thinner, normally being about 3 mm or less in thickness.

What is claimed is:

1. A process for making a meta- and para-aramid pulp for use as reinforcement material, comprising:

(a) combining pulp ingredients including:

(1) pieces of fibrous meta-aramid material, wherein the fibrous meta-aramid material is uncalendered paper having a thickness of 2 to 40 mils and a density of 0.1 to 0.4 g/cm$^3$, being 10 to 90 wt % of the total solids in the ingredients, and having an average maximum dimension of no more than 50 mm;

(2) para-aramid fiber being 10 to 90 wt % of the total solids in the ingredients, and having an average length of no more than 10 cm; and (3) water being 95 to 99 wt % of the total ingredients;

(b) mixing the ingredients to a substantially uniform slurry;

(c) co-refining the slurry by simultaneously:

(1) breaking apart the fibrous meta-aramid material pieces, and cutting and/or masticating the meta-aramid material, into fibril free, fibrous and non fibrous, meta-aramid particles;

(2) fibrillating, cutting and masticating the para-aramid fiber to irregularly shaped fibrillated fibrous structures; and (3) dispersing all solids such that the refined slurry is substantially uniform; and (d) removing water from the refined slurry to no more than 60 total wt % water, thereby producing a meta- and para-aramid pulp with the para-aramid fibrous structures contacting and wrapped partially around at least some of the meta-aramid particles.

2. The process of claim 1, wherein the fibrous meta-aramid material comprises pieces of fibrous meta-aramid paper which comprise paper components including:

(i) meta-aramid fiber being 10 to 90 wt % of the paper, and having a length of 2 to 25 mm; and (ii) non granular, fibrous or film-like, meta-aramid fibrids being 90 to 10 wt % of the paper, and having an average maximum dimension of 0.2 to 1 mm, an aspect ratio of 5:1 to 10:1, and a thickness of no more than 2 microns.

3. The process of claim 1, wherein the ingredients further comprise:

substantially or completely fibril-free, granular, para-aramid particles being no more than 50 wt % of the total solids in the ingredients, and having an average maximum dimension of 50 to 2000 microns; and in the refining step, masticating at least some of the para-aramid particles into smaller, rounder, substantially fibril-free, particles, whereby in the produced meta- and para-aramid pulp, the para-aramid fibrous structures contact and are wrapped partially around at least some of the rounder, substantially fibril-free, para-aramid particles.

4. A process for making a meta- and para-aramid pulp for use as reinforcement material, comprising:

(a) combining ingredients including water and a first material of the group:

(1) pieces of fibrous meta-aramid material, wherein the fibrous meta-aramid material is uncalendered paper having a thickness of 2 to 40 mils and a density of 0.1 to 0.4 g/cm$^3$, being 10 to 90 wt % of the total solids in the pulp, and having an average maximum dimension of no more than 50 mm; and (2) para-aramid fiber being 10 to 90 wt % of the total solids in the pulps, and having an average length of no more than 10 cm;

(b) mixing the ingredients to a substantially uniform suspension;

(c) refining the mixed suspension by:

(1) breaking apart at least some of the fibrous meta-aramid material pieces, and cutting and/or masticating at least some of the meta-aramid material, into fibril free, meta-aramid particles; or (2) fibrillating, cutting and masticating at least some of the para-aramid fiber to irregularly shaped fibrillated fibrous structures;

(d) combining ingredients including the refined suspension, the second material of the group of (a) (1 and 2), and water, if necessary, to increase the water concentration to 95-99 wt % of the total ingredients;

(e) mixing the ingredients, if necessary, to form a substantially uniform slurry;

(f) co-refining the slurry by simultaneously:

(1) breaking apart at least some of the fibrous meta-aramid material pieces and/or cutting and/or masticating at least some of the meta-aramid material, such that all or substantially all of the fibrous meta-aramid material pieces are converted into fibril free, meta-aramid particles; and (2) fibrillating, cutting and masticating at least some of the para-aramid fiber such that all or substantially all of the para-aramid fiber is converted to irregularly shaped fibrillated fibrous structures; and (3) dispersing all solids such that the refined slurry is substantially uniform; and (g) removing water from the refined slurry to no more than 60 total wt % water, thereby producing a meta- and para-aramid pulp with the para-aramid fibrous structures contacting and wrapped partially around at least some of the meta-aramid particles.

5. The process of claim 4, wherein the fibrous meta-aramid material comprises pieces of fibrous meta-aramid paper which comprise paper components including:

(i) meta-aramid fiber being 5 to 97 wt % of the paper, and having a linear density of 1 to 10 dtex and a length of 2 to 25 mm; and (ii) non granular, fibrous or film-like, meta-aramid fibrids being 95 to 3 wt % of the paper, and having an average maximum dimension of 0.2 to 1 mm, an aspect ratio of 5:1 to 10:1, and a thickness of no more than 1 micron.

6. The process of claim 4, wherein the ingredients further comprise:

substantially or completely fibril-free, granular, para-aramid particles being no more than 50 wt % of the total solids in the ingredients, and having an average maximum dimension of 50 to 2000 microns; and in either the first or second refining step, masticating at least some of the para-aramid particles into smaller, rounder, substantially fibril-free, particles, whereby in the produced meta- and para-aramid pulp, the para-aramid fibrous structures contact and are wrapped partially around at least some of the rounder, substantially fibril-free, para-aramid particles.

* * * * *